US006215238B1

(12) United States Patent
Verheggen et al.

(10) Patent No.: US 6,215,238 B1
(45) Date of Patent: Apr. 10, 2001

(54) CATHODE RAY TUBE, ELECTRON GUN FOR A CATHODE RAY TUBE, METHOD FOR MANUFACTURING AN ELECTRON GUN, PARTS USED IN METHOD FOR MANUFACTURING AN ELECTRON GUN

(75) Inventors: Petrus J. M. Verheggen, Sittard; Martinus J. J. M. Leemans; Michiel G. A. M. Van Der Horst, both of Eindhoven, all of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/338,992

(22) Filed: Jun. 24, 1999

Related U.S. Application Data

(62) Division of application No. 08/970,996, filed on Nov. 14, 1997, now Pat. No. 5,951,351.

(30) Foreign Application Priority Data

Dec. 17, 1996 (EP) ..... 96203579

(51) Int. Cl.[7] ..... H01J 29/50

(52) U.S. Cl. ..... 313/417; 313/446; 313/447; 313/438

(58) Field of Search ..... 313/417, 438, 313/451, 456, 457, 446, 447, 409; 445/29, 34, 36

(56) References Cited

U.S. PATENT DOCUMENTS

| | | | | |
|---|---|---|---|---|
| 3,267,316 | | 8/1966 | Drake | 445/34 |
| 3,802,855 | * | 4/1974 | Chelsa | 313/271 |
| 4,605,880 | | 8/1986 | McCandless et al. | 445/34 |
| 4,952,840 | * | 8/1990 | Hale et al. | 313/456 |
| 5,522,750 | * | 6/1996 | Mera et al. | 445/49 |

FOREIGN PATENT DOCUMENTS 187906 7/1994 (JP) .

* cited by examiner

*Primary Examiner*—Nimeshkumar D. Patel
*Assistant Examiner*—Joseph Williams
(74) *Attorney, Agent, or Firm*—Robert J. Kraus

(57) ABSTRACT

A method for manufacturing an electron gun for a cathode ray tube. The method comprises a first step in which a number of securing means are made in a planar element (e.g. plate or strip), a second part in which the securing means are secured to an insulating support rod, a third part in which the insulating support rod-securing means assembly is detached from the planar element, whereafter connections are made to a stack of electrodes to form the electron gun.

2 Claims, 10 Drawing Sheets

CATHODE RAY TUBE, ELECTRON GUN FOR A CATHODE RAY TUBE, METHOD FOR MANUFACTURING AN ELECTRON GUN, PARTS USED IN METHOD FOR MANUFACTURING AN ELECTRON GUN

CROSS REFERENCE TO RELATED APPLICATIONS

This is a divisional of application Ser. No. 08/970,996, filed Nov. 14, 1997 now U.S. Pat. No. 5,951,351.

BACKGROUND OF THE INVENTION

The invention relates to a method for manufacturing an electron gun, in which method a number of electrodes is stacked and secured to a number of insulating support rods by securing means.

The invention also relates to a cathode ray tube having an electron gun for generating an electron beam, the electron gun having a number of electrodes secured to a number of insulating support rods by means of securing means.

The invention also relates to an electron gun for use in a cathode ray tube, the electron gun having a number of electrodes secured to a number of insulating support rods by means of securing means.

Such cathode ray tubes are known and are used in for instance television apparatuses and computer monitors.

Conventional electron guns of cathode ray tubes comprise a number of electrodes, which are positioned one after the other, starting from one cathode (for monochromic cathode ray tubes) or from three cathodes (for colour cathode ray tubes). The electrodes have at their outer circumference securing means secured to electrically insulating support rods. Usually the securing means comprise parts such as protrusions, hooks or brackets which are secured to a number of insulating support rods, for instance by being partly embedded in or attached to a number, usually two, beading rods. The insulating support rods, e.g. beading rods, are usually made of glass and form the back-bone of the electron gun to which the electrodes are attached. In order to attach the electrodes to the beading rods, the electrodes are stacked on each other, for instance in a jig, the beading rods are heated to a temperature at which the glass of the beading rods softens, and the beading rods are pressed against the securing means. Thereby the securing means are at least partly embedded in or attached to the softened material of the beading rods, i.e. secured to the insulating support rods. Thereupon the temperature is lowered, and the material of the rods solidifies, trapping part of the securing means in the beading rods.

Although the conventional design and method for manufacturing have been used with some success, the inventor has realized that the ever higher demands that are placed on the performance of the electron gun and the strive for cost reduction have made the disadvantages of the conventional design ever more relevant. It is very difficult in the conventional design to maintain an accurate positioning of the electrodes with respect to each other. Any change of the positions of the electrodes introduces an error in the position and/or shape of the electron beams on the display screen and/or on the relative positions of the electron beams. Such errors have a detrimental effect on the quality of the image on the display screen. Furthermore the number of parts necessary for the manufacturing of the electron gun increases as the number of electrodes increases. This adds to the cost of manufacturing and furthermore increases the risk that the electron gun comprises a flaw.

OBJECTS AND SUMMARY OF THE INVENTION

It is an object of the invention to provide a method for manufacturing an electron gun in which one or more of the above mentioned problems are decreased or alleviated.

To this end the method for manufacturing the electron gun is characterized in that it comprises the following method steps:

- in a planar element a pattern of openings is made, thereby forming a number of securing means attached to the remainder of the plate,
  - parts of said securing means are bend out of the plane of the planar element,
  - a number of said bend parts are secured to an insulating support rod,
  - the insulating support rod-securing means assembly is disconnected from the remainder of the planar element,
  - a number of insulating support rods are made to engage a stack of electrodes via said securing means and
  - said securing means and the stack of electrodes are interconnected.

The method according to the invention uses a planar element, e.g. a flat plate or strip of material in which a number of securing means are made, which, further in the method of manufacturing, will interconnect the electrodes and the insulating support rods. In conventional designs and manufacturing method each electrode is secured to a pair or a number of pairs of securing means, each pair comprising a securing means at opposite sides of the electrode. For flat electrodes the securing means are usually protrusions at the periphery of the electrode, for tubular or cylindrical electrodes hooks or brackets are used which are attached to the electrodes. The number of different elements is large and the number of attachment steps is also large. Because the securing means in the invention are no separate elements, but either form part of the planar element, or part of the insulating support rod-securing means assembly, the effective number of different elements, i.e. the number of elements that have to be dealt with separately is strongly reduced. The reduction of the effective number of elements effects a substantially reduction of the cost of manufacturing. Furthermore, there is no need to exert pressure on the electrodes during interconnecting the electrodes and the beading rods as in the conventional method. This reduces the risk that the electrodes change position, thereby increasing the average quality of the electron guns and reducing the manufacturing loss. The electrodes are also not subjected to high temperatures which reduces the thermal stresses in the electron gun. This results in an improved average quality of the electron gun.

The securing means can be secured in various ways to the insulating support rod, for instance by clamping. In preferred embodiments bend parts of the securing means are made to engage an insulating support rod, which is at a high temperature, and embedded at least partly in the support rod. This process is usually called "beading", and the insulating support rods are called "beading rods". The method can be used very advantageously in such beading processes because the invention make it possible to control much more accurately the temperature of the beading rod and the force, speed and direction with which the securing means are embedded in the beading rod. In the conventional method all beading rods (usually two or four) are simultaneously heated by differing heating devices (usually some type of flame torches) and simultaneously forced against the securing means. It is however very difficult in such conventional method to ensure that all beading rods have throughout the length of the beading rod the same temperature and that all beading rods are, throughout the length of the beading rod forced against the securing means with the same force (in strength and direction). In the method according to the preferred embodiment of the invention, however, the securing means attached to the plate are secured to the beading rods in a method step separate from the method steps in which the electrodes are stacked. This enables a greater control on important parameters such as the temperature of the beading rod, the force with which the securing means and beading rod are pressed to each other, the rate of cooling, and the separation between the securing means. As a result better and better controllable connections between the securing means and the beading rods can be made.

In a preferred embodiment of the invention the pattern of openings is made by means of etching the openings in the planar element.

Etching the openings can be done with a great accuracy and does not introduce mechanical stresses in the material of the planar element. Mechanical stresses can lead to shifts in the positions of the electrodes.

Alternatively, other methods for making the patterns of openings can be used for instance laser cutting or stamping.

A preferred embodiment is characterized in that the first and second mentioned method steps (making a pattern of openings and bending parts of the elements out of the plate) are performed simultaneously. This can be achieved for instance by a combined stamping/bending method. Doing both method steps simultaneously reduces the number of manufacturing steps and the manufacturing time.

In a preferred embodiment of the invention two or preferably more than two securing means are interconnected by means of at least one interconnecting lead, the lead and the securing forming a solid part.

The invention makes it possible, and this is the subject of preferred embodiments, to provide interconnecting leads between electrodes (via securing means of different electrodes), which form one solid part with the securing means. In fact the securing means and the interconnecting lead are formed from one and the same plate or strip (planar element). The number of parts necessary to make the electron gun is further reduced.

In a related preferred embodiment of the invention at the cathode side of the beading rod a base securing means is provided, and a interconnecting lead is present between the base securing means and a securing means of an electrode, the base securing means, the interconnecting lead and the securing means of the electrode forming one solid part.

The number of parts is further reduced, the reliability of the interconnection between the base securing means and the electrode is increased and welding the interconnecting lead to the base securing means on the electrode is no longer unnecessary. The invention also relates to a planar apertured (i.e. having the openings) element (e.g. plate or strip) for use in the method according to the invention. Such planar elements can advantageously be made in the form of reels. The invention therefore also relates to a reel comprising planar elements to be used in the method according to the invention.

The invention furthermore relates to a cathode ray tube having an electron gun for generating an electron beam, the electron gun having a number of electrodes secured to a number of insulating support rods, at least two electrodes have securing means, securing the electrodes to the insulating support rods, interconnected by a interconnecting lead, characterized in that securing means of the two electrodes and the interconnecting lead form one solid part.

The invention furthermore relates to a cathode ray tube having an electron gun for generating an electron beam, the electron gun having an electrode secured to a number of insulating support rods by securing means and a base securing means, interconnected by a interconnecting lead, characterized in that a securing means of an electrode, the base securing means and the interconnecting lead form one solid part.

The invention also relates to an electron gun for use in a cathode ray tube.

BRIEF DESCRIPTION OF THE DRAWINGS

These and further aspects of the invention will be explained in greater detail by means of exemplary embodiments and with reference to the accompanying drawings, in which.

The figures are not drawn to scale. In general, like reference numerals refer to like parts in the Figures.

DESCRIPTION OF THE PREFERRED EMBODIMENTS

Figure 1:
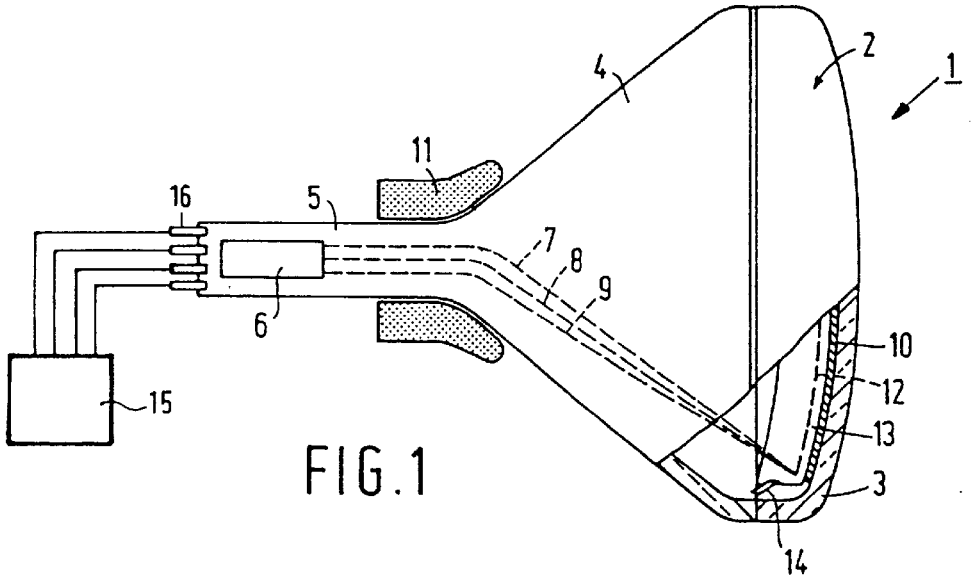
FIG. 1 is a sectional view of a display device.
Figure 2:
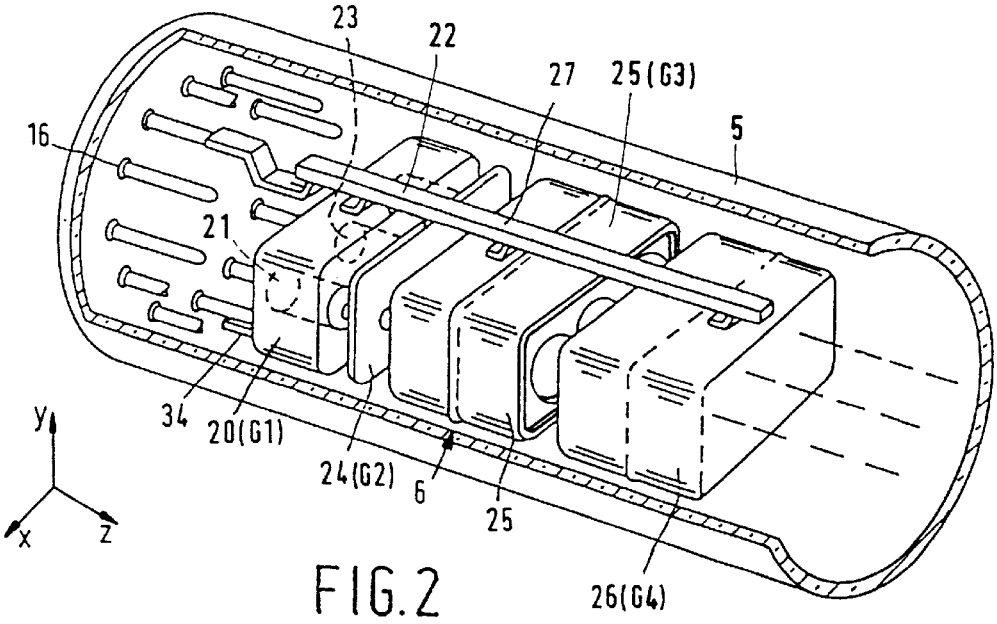
FIG. 2 is a sectional view of a simplified electron gun.

FIG. 1 shows a cathode ray tube, in this example a colour cathode ray tube 1, which comprises an evacuated envelope 2 comprising a display window 3, a cone portion a and a neck 5. In said neck 5 there is provided an electron gun 6 for generating three electron beams 7, 8 and 9 which extend in one plane, the in-line plane, which in this case is the plane of the drawing. A display screen 10 is provided on the inside of the display window. Said display screen 10 comprises a large number of phosphor elements luminescing in red, green and blue. On their way to the display screen, the electron beams are deflected across the display screen by means of an electromagnetic deflection unit 11 and pass through a colour selection electrode (sometimes also called a shadow mask) 12 which is arranged front of the display window 3 and which comprises a thin plate having apertures 13. The colour selection electrode is suspended in the display window by means of suspension elements 14. The three electron beams pass through the apertures 13 of the colour selection electrode at a small angle with respect to each other and, consequently, each electron beam impinges on phosphor elements of only one colour. The cathode ray tube, in this example, further comprises means is for generating, in operation, voltages which are applied to electrodes of the electron gun via feedthroughs 16. FIG. 2 is a sectional view of a simplified electron gun. Said gun comprises three cathodes 21, 22 and 23. Said electron gun further comprises a first common electrode 20 (G1), a second common electrode 24 (G2), a third common electrode 25 (G3) and a fourth common electrode 26 (G4). By applying voltages, via feedthroughs 16, and, in particular by applying voltages differences between the electrodes and/or sub-electrodes, electron-optical fields are generated for forming, accelerating, adjusting and/or focusing the electron beams. Electrodes G1, G2 and G3 constitute, in this example, an electron-optical element for generating a pre-focusing lens, electrodes G3 and G4 constitute an electron-optical element for generating a main lens which, in operation, is formed between these electrodes for focusing the electron beams on the display screen. The electrodes are secured to insulating support rods, in this figure to beading rods 27, in this example glass beading rods, via securing means 28.

Figure 3A:
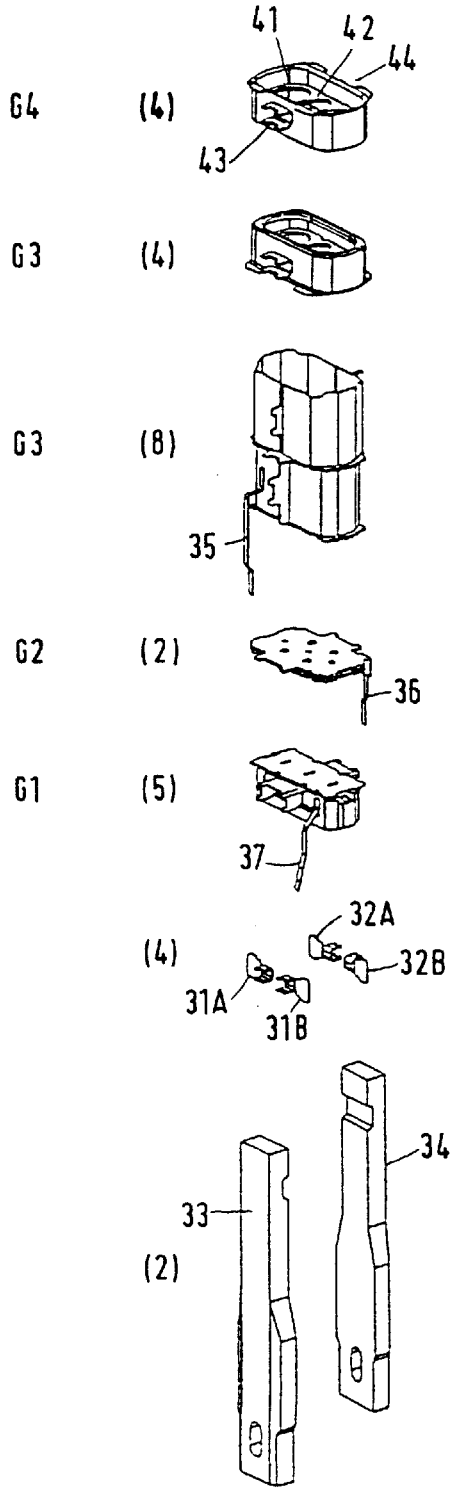
FIG. 3A is a drawn-out drawing of a conventional electron gun
Figure 3B:
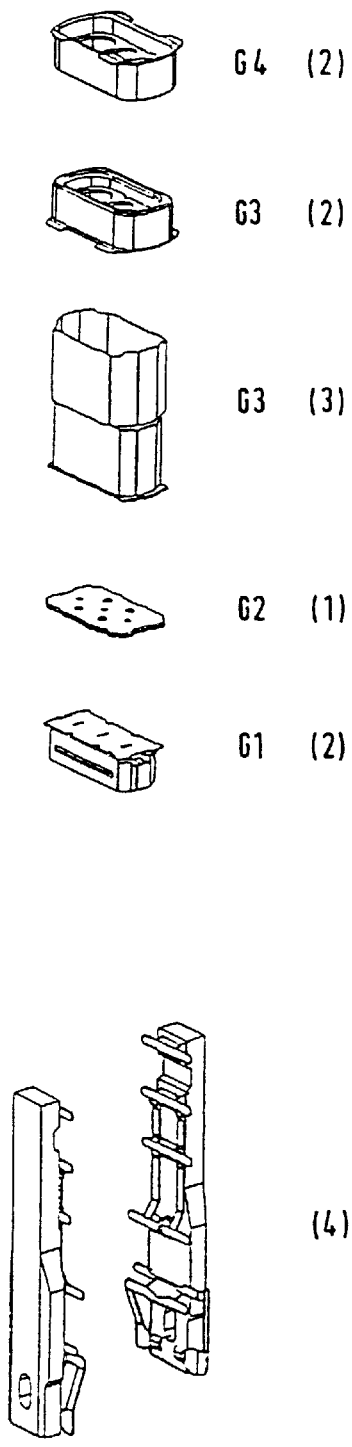
FIG. 3B is a drawn-out drawing of an electron gun according to the invention.

FIGS. 3A and 3B show the set-up of a conventional electron gun (to the left, FIG. 3A) and of an electron gun according to the invention (to the right, FIG. 3B). The electron gun shown in FIG. 3A and FIG. 3B is slightly more complex than the electron gun shown in FIG. 2, because the G3 electrode comprises two sub-electrodes G3A and G3B. Apart from the electrodes G1, G2, G3A, G3B and G4 FIG. 3A also shows base securing means 31A, 31B and 32A and 32B which, in the assembled electron gun, are attached to the base portion of the beading rods 33 and 34, as well as three leads 35, 36 and 37. Next to the electrodes the number of elements, including any leads, is given. For instance in the conventional electron gun the G4 electrode is comprised of four different parts, a tubular part 41, a flat inner part 42 and two securing means 43 and 44. In contrast the electrode G4 in FIG. 3B comprises only two parts. The total number of parts has been reduced from 29(=4+4+8+2+5+4+2) for the conventional design in FIG. 3A to 14 (=2+2+3+1+2+4) for the design shown in FIG. 3B. This reduction in the number of different parts result in considerable cost savings. The reduction is due to the fact that all the different securing means as well as the leads are made from two single plates. Apart from the reduction of the number of elements the conventional design shown in FIG. 3A the number of manufacturing steps is also greatly decreased. In the manufacturing of the design as shown in FIG. 3A all electrodes must be provided with securing means. For some of the electrodes the securing must be welded to the electrodes. These manufacturing steps can be dispensed with in the design as shown in FIG. 3B. Furthermore the leads 35, 36 and 37 in the conventional design have to be welded at both ends. In the design shown in FIG. 3B the leads form one solid part with the other parts (securing means) to which it is attached. Welding is not necessary. Not only does this lead to a reduction in the number of welds, the interconnecting leads are also stronger and more reliable. Furthermore in the prior-art some of the welds have to be made manually, which is in particular an error-prone process. An added advantage of the design shown in FIG. 3B over the design shown in FIG. 3A is that the shape and form of the electrodes is much less complicated. The electrodes shown in FIG. 3A when used in large quantities easily become entangled. This is in particular true once the electrodes have been provided with leads (35,36,37). Some of the electrodes shown in FIG. 3A are so complex that they have to be dealt with manually. The electrodes shown in FIG. 3B are of a simpler design and do not become entangled. This reduces the risk of damage to the electrodes and the risk that the manufacturing process has to be stopped temporarily. In summary: the reliability and strength of the interconnecting between the electrodes is improved and a further advantage is that there are no welds necessary between electrodes and the interconnecting lead. Welding is a time consuming and error-prone method, which also introduces fumes and other aggressive materials in and near the electron gun, which have to be removed.

Figure 4A:
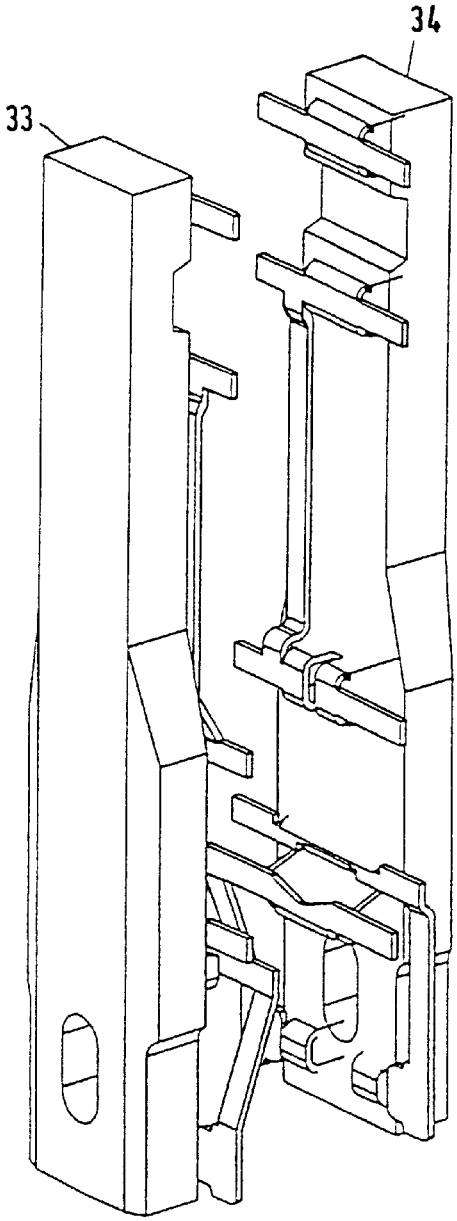
FIGS. 4A, 4B and 4C show beading rods with the securing elements (FIG. 4A), the assembled electron gun with the beading rods removed from the drawing to show the position of the securing elements vis-a-vis the electrodes (FIG. 4B), and the securing means (FIG. 4C).
Figure 4B:
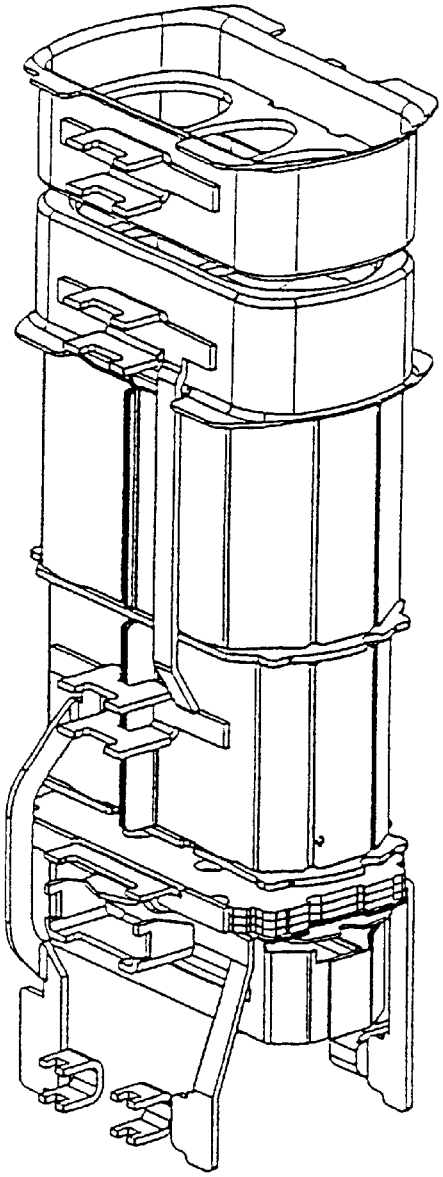
Figure 4C:
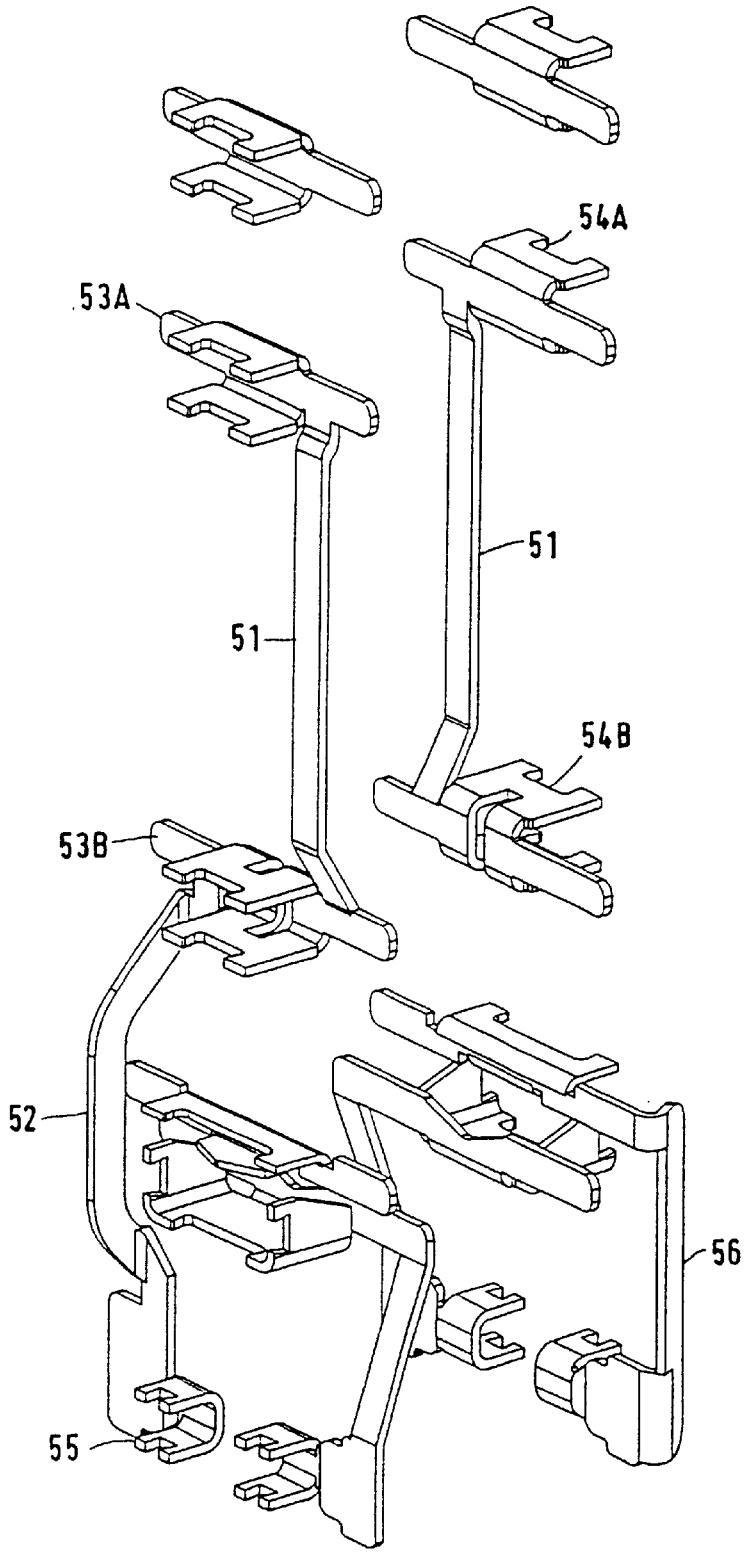
Figure 5A:
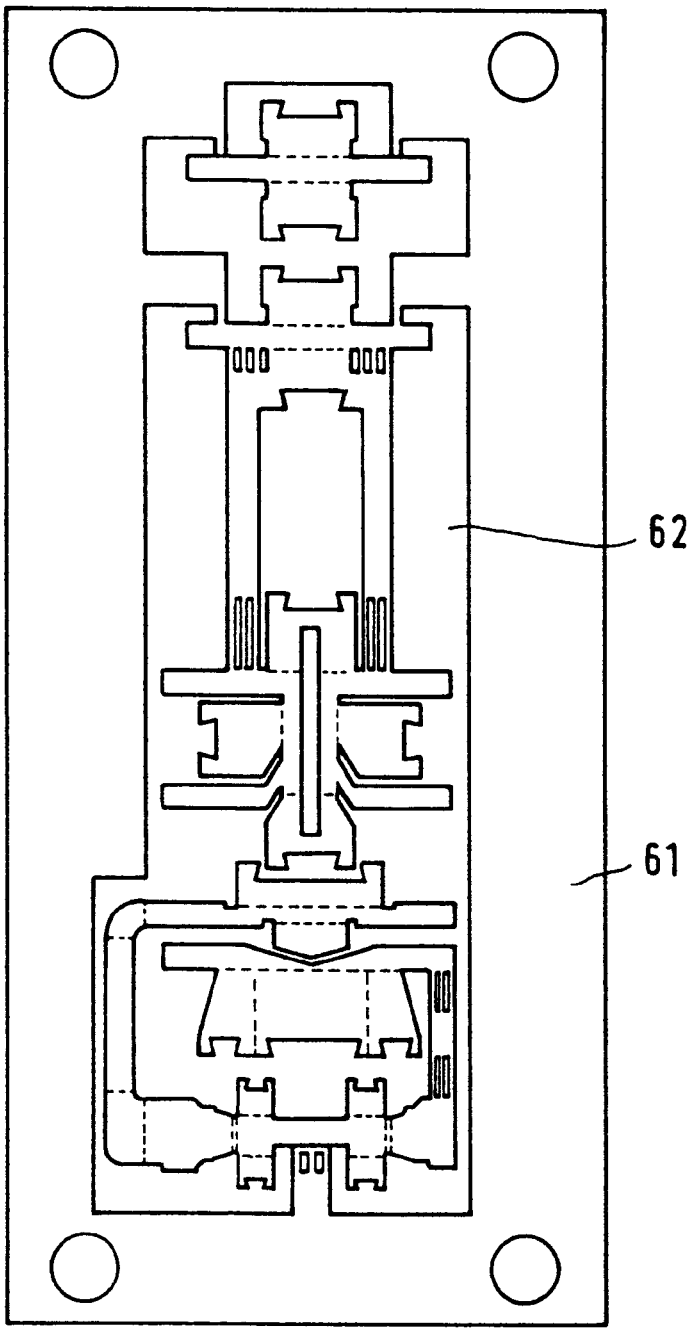
FIGS. 5A to 5D illustrate the method according to the invention.
Figure 5B:
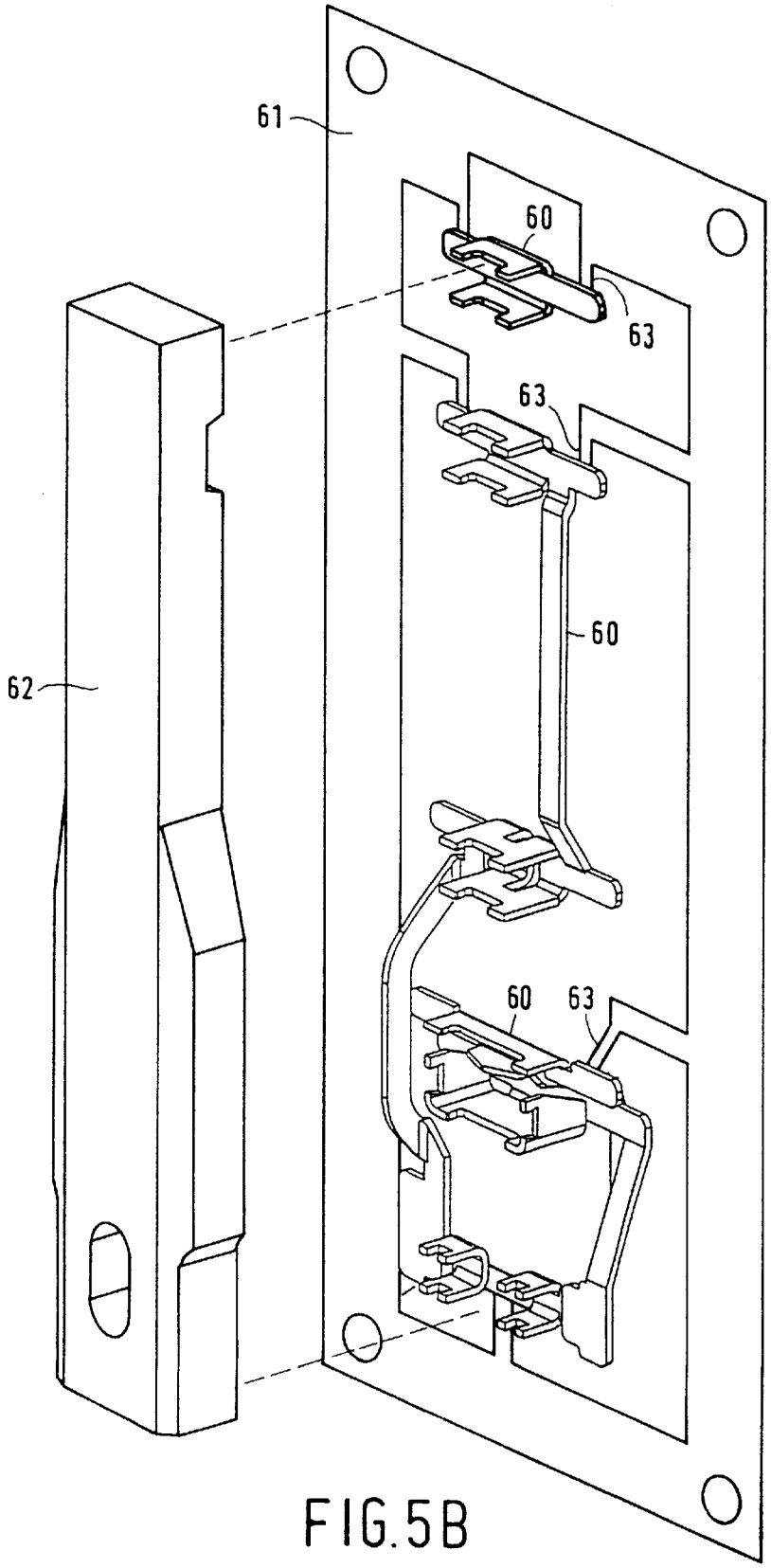
Figure 5C:
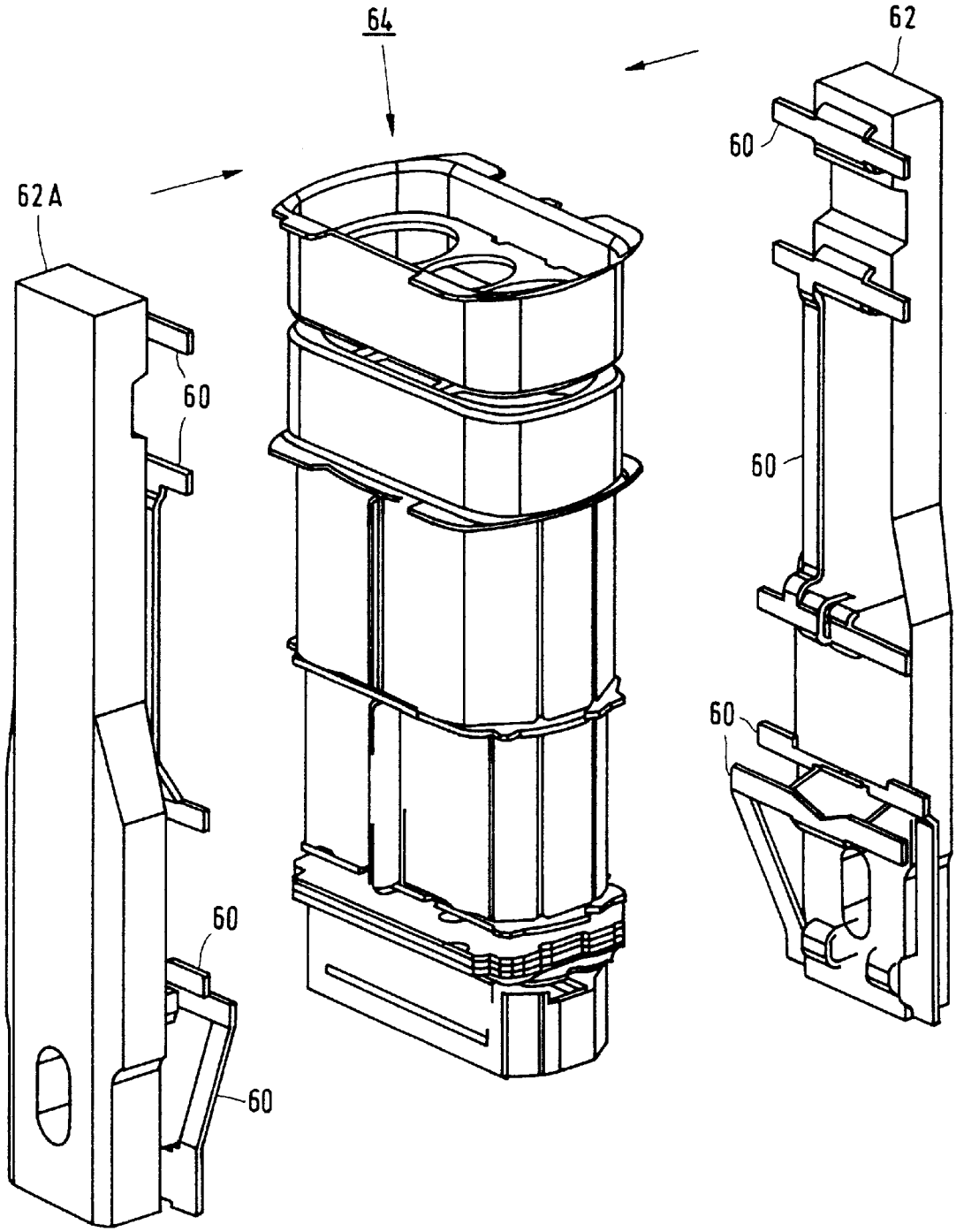
Figure 5D:
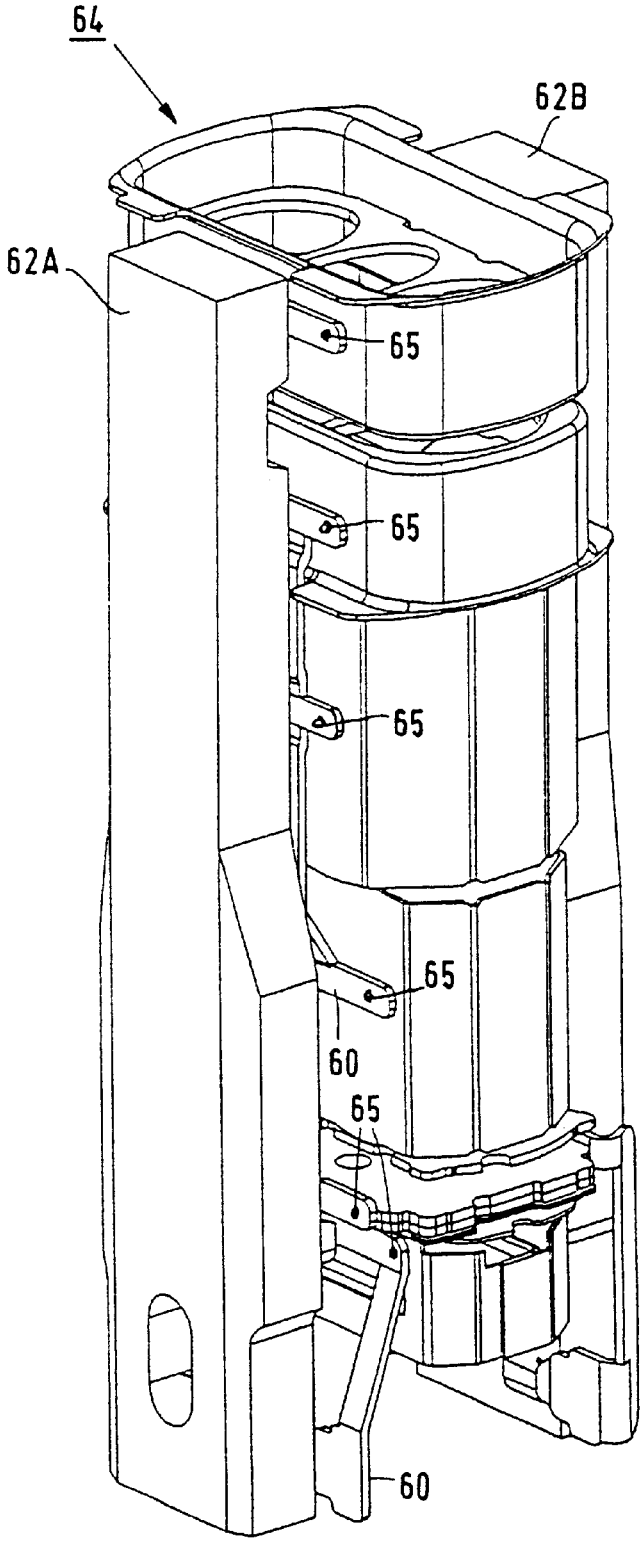

FIG. 4A shows the beading rods 33, 34 of FIG. 3B to which the securing means are attached. FIG. 4B shows the electrodes with the securing means attached to the electrodes. FIG. 4C shows the securing means separately. In FIG. 4C is shown that some of the securing means are interconnected via leads. For instance, leads 51 and 52 interconnect the securing means 53A and 54A to securing means 53B and 54B (via leads 51) and to base securing means 55 and securing means 53B. The interconnecting leads 51 form a solid part with securing means 53A and 53B, respectively with securing means 54A and 54B. Interconnecting lead 52 forms a solid part with the base securing means 55. The securing means 53B is in the electron gun attached to electrode G3. Interconnecting lead 52 is in function equivalent to lead 35 as shown in FIG. 3A. The reliability of the connection between the base securing means and electrode G3, which is vital for a proper functioning of the electron gun is for the lead 52 (FIG. 4C) greater than for lead 35. Lead 35 can, dependent on the quality of the weld made between the lead and the G3-electrode and the base securing means 31A become detached. Lead 52 forms a solid part with the securing means and cannot become detached. FIG. 4C also shows that the assembly of securing means is, in this example, comprised of two separate and different assemblies. The assembly "facing the viewer" and the assembly of securing means at the "right-hand side" in this example are not identical. The interconnecting lead 52 is present only in the system "facing the viewer". The interconnecting lead 56 is only comprised in the system at the right-hand-side". This asymmetry between the systems of securing means (which means that the openings in the plates have to be different) is a preferred embodiment because it enables to make four interconnecting leads between securing means and the base brackets. FIG. 5A shows a plate 61 having openings 62, which openings have been, in accordance with a preferred embodiment of the invention, made by means of etching. The openings could, within the framework of the invention, also be made by other means, for instance by stamping. Stamping, however, introduces mechanical stresses in the material of the plate, which could lead to an inaccurate positioning of the electrode. Furthermore stamping introduces burrs and loose particles, which can lead to high voltages problems in the electron gun. FIG. 5B shows plate 61 after bending of several parts to form securing means 60. Plate 61 is thereafter via securing 60 brought in contact with a beading rod 62, which is heated to such a temperature that the material is softened. This is advantageously done in a oven, where the temperature of the beading rod can be accurately controlled and maintained and the subsequently reduction of the temperature can also be controlled. In the conventional method the beading rods are heated in situ, next to the stacked electrodes, for instance by means of flames. The temperature of the beading rods is in the conventional method controlled to a much lesser degree, as is the subsequent reduction of the temperature. The increased control of the temperature leads to a better control of the formation of the connection between the securing elements and the beading rods and thus to more reliable connections between the beading rod and the securing means. When the plate 61 (with the securing means) and the beading rod are attached to each other via the securing means 60 the beading rod-securing means assembly is cut loose from the remainder of the plate, for instance by cutting parts 63 of plate 61. FIG. 5C shows the following step in the method for manufacturing. A number of electrodes of electron gun 64 are stacked upon each other, for instance in a jig. For clarity the jig is not shown in FIG. 5C. When the stacking procedure is completed, beading rods 62A and 62B (the left and right beading rod) are brought into contact with the stack of electrodes, and the securing means 60 engage the electrodes. The result is shown in FIG. 5D. Thereafter joints, for instance laser welds 65 are made to interconnect the securing means and the electrodes.

Figure 6:
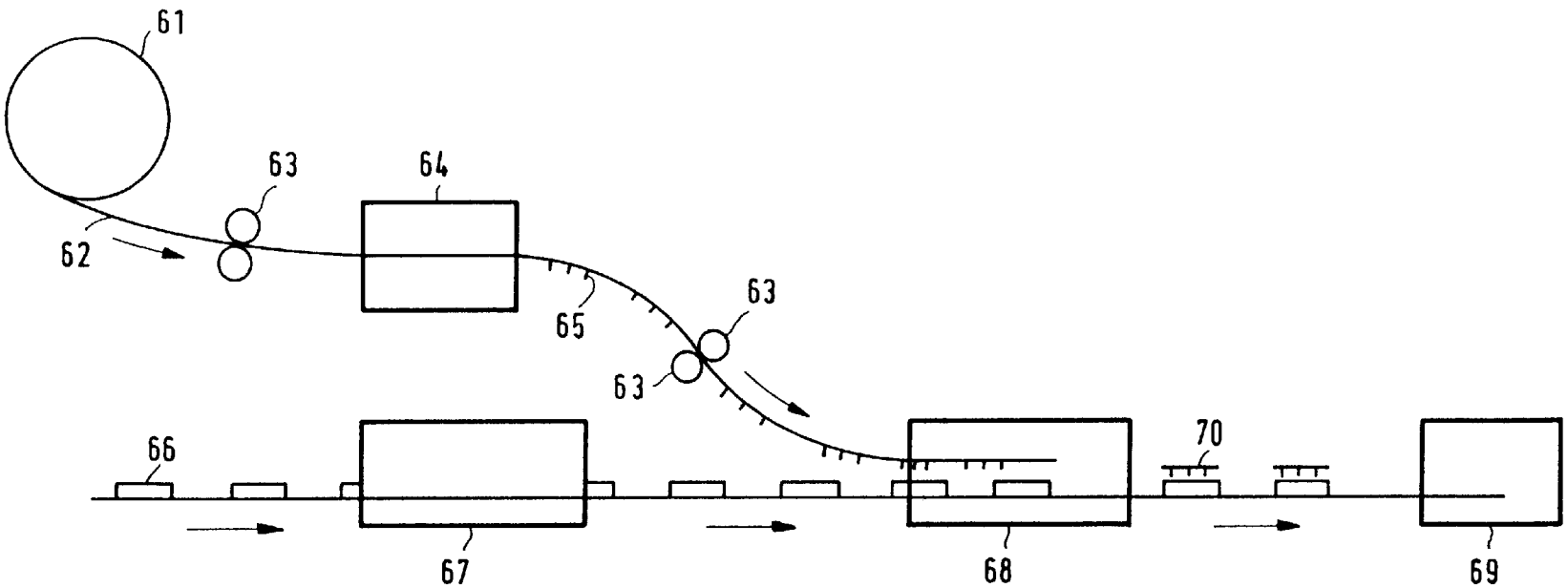
FIG. 6 shows an apparatus for attaching the securing means to the insulating support rods and forming insulation support rod-securing means assemblies.

FIG. 6 shows schematically an example of an apparatus for performing part of the method in accordance with the invention. Reel 61 comprises a strip 62. By means of rollers 63 the strip 62 is transported through a bending device 64, in which, if the openings are present in the strip, parts 65 are bend out of the plane of strip 62, or, if the strip on the reel did not comprise openings, openings are made, for instance stamped, in the strip and parts 65 are bend out of the plane of the strip. Insulating support rods 66 are heated in an oven 67 to a high temperature. The insulating support rods 66 and the strip 62 are brought together in device 68, in which the temperature of the insulating support rods is maintained at the proper value, and in which the bend parts 65 are made to be embedded (pushed into) the insulating support rods and the insulating support rod-securing means assemblies 70 are disconnected from the remainder of the strip 62. The insulating support rod-securing means assemblies are, preferably, subsequently checked for flaws in control unit 69.

Figure 7:
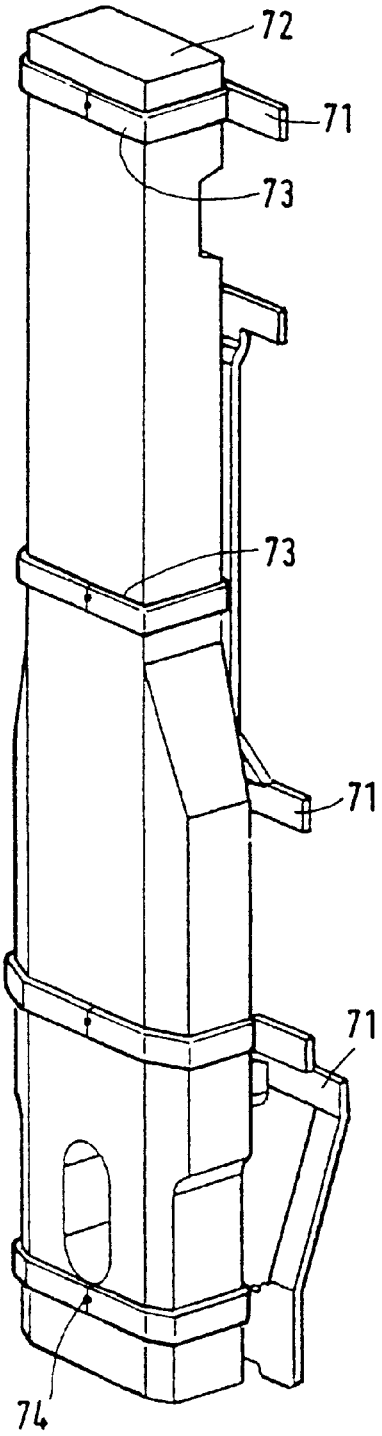
FIG. 7 shows a further embodiment of securing the securing means secured to an insulating support rod.

FIG. 7 shows an alternative manner for securing the securing means to the insulating support rods. In this example the securing means 71 do not have parts embedded in the insulating support rod 72, but comprise braces 73 which are clamped around the insulating support rod 72 and are welded to each other by means of laser welds 74. A interconnection between the securing means 71 and the insulation rod 72 can be made in this manner. If the braces 73 are clamped around the insulating support rod 72 and welded to each other at a high temperature, the thermal contraction of the braces will ensure a reliable interconnection.

Summarizing: the invention provides a method for manufacturing an electron gun for a cathode ray tube, the method comprising a first step in which a number of securing means are made in a planar element (e.g. plate or strip), a second step in which the securing means are secured to an insulating support rod, a third step in which the insulating support rod-securing means assembly is detached from the planar element, whereafter connections are made to a stack of electrodes to form the electron gun or part of the electron gun. The invention also provides an electron gun wherein securing means of different electrodes form a single solid part with an interconnecting lead.

What is claimed is:

1. Cathode ray tube having an electron gun for generating an electron beam, the electron gun having a number of electrodes secured to a number of insulating support rods by means of securing means, characterized in that at least two securing means are interconnected by means of at least one interconnecting lead, the interconnecting lead and the respective securing means forming one solid part.

2. Cathode ray tube as claimed in claim 1, characterized in that at the cathode side of the insulating support rod a base securing means is provided, and a interconnecting lead is present between the base securing means and a securing means of an electrode, the base securing means, the interconnecting lead and the securing means of the electrode forming one solid part.

* * * * *